United States Patent [19]

Corah

[11] Patent Number: 4,656,738

[45] Date of Patent: Apr. 14, 1987

[54] RAZOR HOLDING MEANS FOR SHAVING CREAM CANS

[76] Inventor: Allan J. Corah, 6812 N. Willamette Blvd., Portland, Oreg. 97203

[21] Appl. No.: 761,155

[22] Filed: Aug. 1, 1985

[51] Int. Cl.[4] ..... B26B 21/44

[52] U.S. Cl. ..... 30/41; 30/90

[58] Field of Search ..... 30/41, 41.5, 90, 296 A; 24/3 M; 220/85 M; 215/100 R, 101

[56] References Cited

U.S. PATENT DOCUMENTS

| | | | |
|---|---|---|---|
| 2,184,645 | 12/1939 | Key | 30/41 X |
| 2,219,834 | 10/1940 | Davis | 215/100 R |
| 3,339,608 | 9/1967 | Brenner | 150/52 |
| 3,384,961 | 5/1968 | Boyce | 30/90 |
| 3,412,465 | 11/1968 | Anderson | 30/41 |
| 3,754,326 | 8/1973 | Glaberson | 30/40 |
| 4,198,745 | 4/1980 | Moehlenpah | 30/90 |
| 4,480,387 | 11/1984 | d'Arc | 30/41 |

*Primary Examiner*—Jimmy C. Peters

*Attorney, Agent, or Firm*—Eugene M. Eckelman

[57] ABSTRACT

One or more recesses are provided in a shaving cream can for releasably engaging the head or handle, or both, of a safety razor for supporting the razor on the can. The recess or recesses may be provided in the lid of the can or in a band releasably attachable to a can when it is desired to discard the original lid.

2 Claims, 4 Drawing Figures

RAZOR HOLDING MEANS FOR SHAVING CREAM CANS

BACKGROUND OF THE INVENTION

This invention relates to a new and novel razor holding means for shaving cream cans.

A great number of men and women who use safety razors also use the canister type shaving cream dispensers employing a container for the shaving cream and a lid which covers a dispensing nozzle on the container. Generally, the shaving cream can and the safety razor are stored separately and thus these two elements must be brought out from their respective storage areas when put in use. This of course has the disadvantage that the two elements must be individually handled and stored in respective locations when not in use. Oftentimes, the safety razor is thrown in a drawer or the like and in addition to the necessity for finding it, the blade is frequently damaged. The blades also are often damaged while traveling.

SUMMARY OF THE INVENTION

According to the present invention and forming a primary objective thereof, holding means are provided in association with a shaving cream can for releasably holding a safety razor thereon whereby the razor will always be with the shaving cream can and in addition the blade of the razor is protected from damage.

Another objective of the invention is to provide holding means of the type described with razor engaging structure for releasably holding the safety razor on the can such that the razor is readily attached and detached.

Another objective of the invention is to provide embodiments which provide support of the razor on the lid of the can, or in those cases where the lid is discarded, means are provided for supporting the razor directly on the container portion of the can.

In carrying out the objectives of the invention, holding means are provided which includes structure for removably attaching a safety razor to a shaving cream can in an arrangement such that the safety razor is suitably supported and stored when not in use but it can be readily released when the razor is to be used. The structure includes recess means either on the lid or on the can, or both, facilitating frictional or engagement of the head of the razor or the handle, or both, to accomplish the desired releasable connection.

The invention will be better understood and additional objectives will become apparent from the following description taken in connection with the accompanying drawings.

DETAILED DESCRIPTION OF THE PREFERRED EMBODIMENTS

Figure 1:
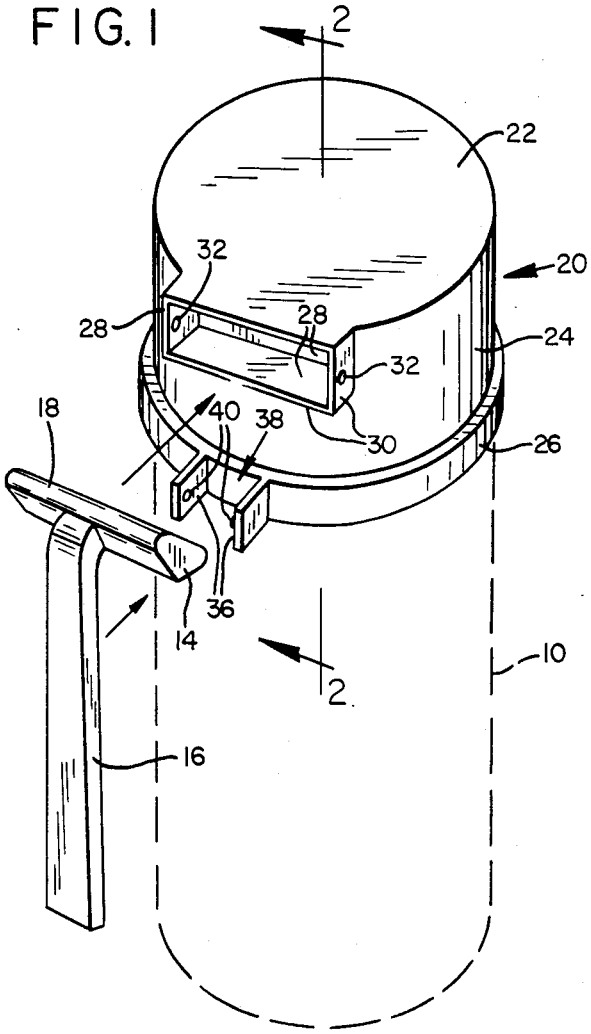
FIG. 1 is a perspective view of one embodiment of safety razor holding means in association with a shaving cream can.

With particular reference to the drawings, the numeral 10 designates a container portion of a conventional shaving cream can, namely, a pressurized canister type container carrying a supply of shaving cream and having a top dispensing nozzle portion 12. The numeral 14 designates a conventional safety razor having a handle portion 16 and a cross head portion 18 with the usual blade, not shown, therein.

Figure 2:
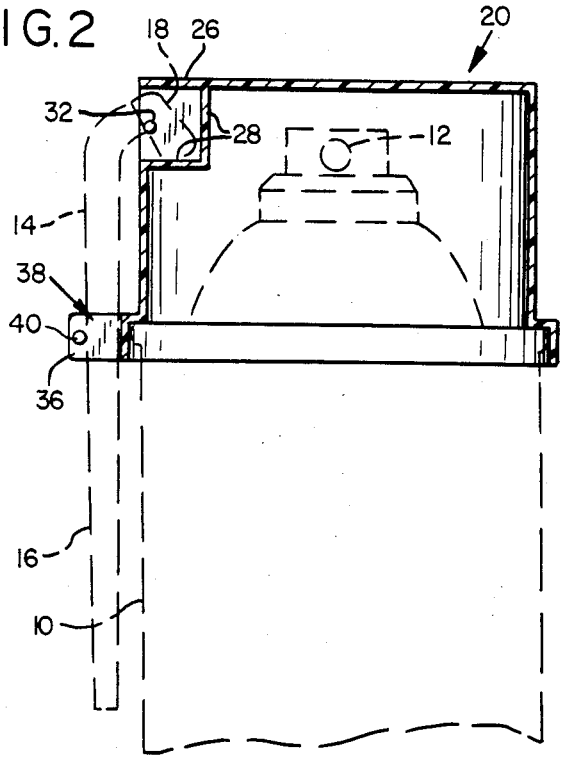
FIG. 2 is a cross sectional view taken on the line 2—2 of FIG. 1, the lid portion being shown in full lines and the container portion being shown in phantom lines.

According to a first embodiment of the invention, FIGS. 1 and 2, a lid 20 is provided having a top wall 22 and a peripheral defining wall 24 depending from the top wall. The lid 20 has a bottom reinforcing peripheral flange 26 and is dimensioned and arranged to fit on the conventional container portion 10 as shown in FIG. 2. In existing shaving cream cans, the conventional lid is discarded when the present invention is to be employed and the present lid 20 substituted therefor, or of course the lid 20 can be furnished from the manufacturer or other source on new cans.

Lid 20 is formed with a recessed projection 28 having defining walls 30 arranged to receive the cross head 18 of the safety razor therein. It is preferred that a frictional engagement be provided between the razor head 18 and recessed projection 28 and for this purpose one or more walls of the projection 28 are provided with inwardly directed beads 32 which frictionally engage the side edges of the head 18. By the use of a customary semi-rigid type plastic for this type of product, there is sufficient frictional engagement to firmly hold the razor in place but at the same time the razor is easily pulled out of the recess.

The razor engaging structure thus far described will adequately hold a razor in place. However, additional means can also be combined with recess 28 comprising a pair of projections 36 which form a recess 38 for receiving a handle portion of the safety razor. The projections 36 are provided with a pair of inwardly directed beads 40 arranged for frictional engagement with side edges of the razor handle for holding the handle in place. It is desired that the razor holding means heretofore described grip the razor to an extent that the razor will not fall off even when the can is turned upside down.

Figure 3:
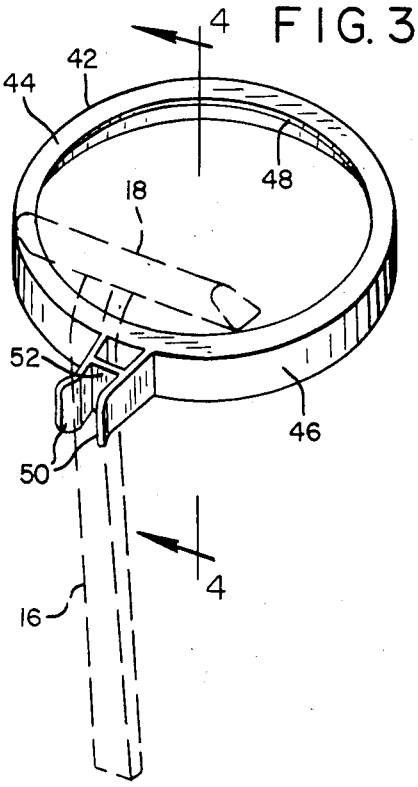
FIG. 3 is a perspective view of a second embodiment of the invention comprising a band for support on the container portion, the band being shown apart from the container portion.
Figure 4:
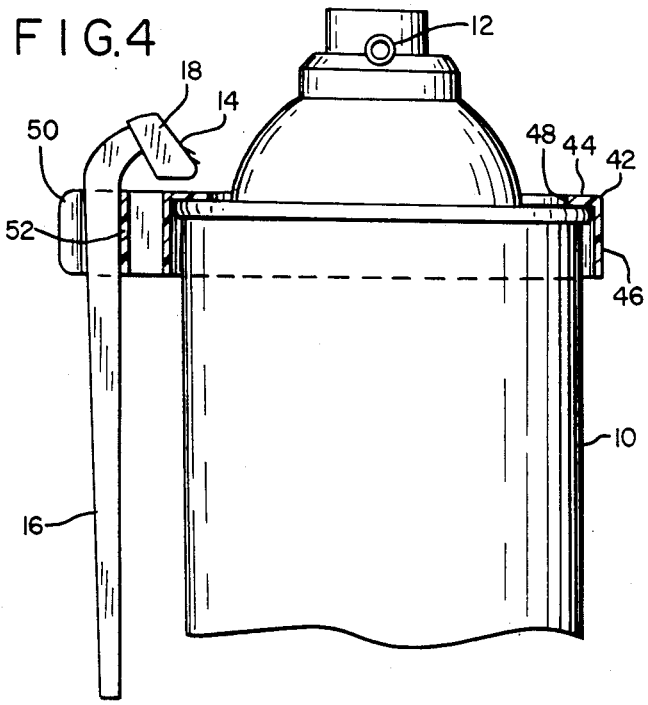
FIG. 4 is a cross sectional view of the band of FIG. 3 but showing the band in place on the container portion of a shaving cream can.

The embodiment shown in FIGS. 3 and 4 comprises a band or ring 42 arranged to seat on the can and be utilized to hold a razor on the container portion for those situations where the lid of the shaving cream can is discarded. This band has a top wall 44 arranged to seat on the can and a depending flange 46 for snugly holding the band on a can by frictional engagement. The central opening 48 in the band provides clearance for the nozzle dispensing portion 12. This band has a pair of projections 50 which form a slot to frictionally receive the handle portion of the razor. These projections may comprise spring fingers. A reinforcing web 52 is connected between the fingers at a point intermediate their connected and free ends, and this reinforcing web also spaces the razor outwardly so that the head portion will be disposed outwardly in a clearance arrangement with the upper dispensing portion of the container. In the use of the embodiment of FIGS. 3 and 4, the lid, if furnished with the shaving cream can may be discarded and the band 42 mounted in its place. Here again, the engagement of the fingers 50 with the razor handle is snug enough to prevent accidental displacement of the razor.

In each embodiment, the safety razor is readily supported on the shaving cream can and is always convenient for shaving. Also, since the razor is supported on the can, the latter will protect the blade edge from damage, especially when traveling. The combined arrangement of the can and razor saves on cabinet space.

It is to be understood that the forms of my invention herein shown and described are to be taken as preferred examples of the same and that various changes in the shape, size and arrangement of parts may be resorted to without departing from the spirit of my invention, or the scope of the subjoined claims.

Having thus described my invention, I claim:

1. A safety razor supporting device arranged for use with a shaving cream can and a safety razor having a handle and a blade carrying head, said device comprising a circular open center band having a flat top wall portion and an outer depending flange on said top wall portion, said band being arranged to be removably fitted on an upper portion of a shaving cream can with said top wall portion lying on a top edge of the can and said flange extending in snug relation down on the can and with a nozzle dispensing portion of the can projecting therethrough;

recess means formed in said band dimensioned and arranged removably to receive a portion of a safety razor therein for supporting a razor on the band when the razor is not in use but to allow ready release from the band when the razor is to be used, said recess means comprising a pair of projections extending outwardly from said depending flange and forming an upright slot therebetween for frictionally receiving the handle of a safety razor therein for removably supporting the razor on a shaving cream can;

and an upright web portion between said projections intermediate the ends thereof for selectively spacing the head of the razor outwardly from a shaving cream can on which the razor is mounted.

2. In combination, a shaving cream can having a top edge and an upwardly projecting nozzle dispensing portion;

a safety razor having a handle and a blade carrying head;

and a razor supporting device arranged for mounting on said can comprising a circular open center band having a flat top wall portion and an outer depending flange on said top wall portion and arranged when mounted on said can to receive said nozzle dispensing portion of said can therethrough, said band being removably fitted on an upper portion of said shaving cream can with said top wall portion lying on the top edge of the can and said flange extending in snug relation down on the can;

recess means formed in said band dimensioned and arranged removably to receive a portion of said safety razor therein for supporting said razor on said band when said razor is not in use but to allow ready release from the band when said razor is to be used;

said recess means comprising a pair of projections extending outwardly from said depending flange and forming an upright slot therebetween for frictionally receiving the handle of a safety razor on a shaving cream can;

and an upright web portion between said projections intermediate the ends thereof for selectively spacing the head of the razor outwardly from a shaving cream can in which the razor is mounted.

* * * * *